United States Patent [19]

Ritchie

[11] 4,056,336

[45] Nov. 1, 1977

[54] APEX SEALS FOR SLANT AXIS ROTARY MECHANISMS

[75] Inventor: James A. Ritchie, Hampton-in-Arden, England

[73] Assignee: Caterpillar Tractor Co., Peoria, Ill.

[21] Appl. No.: 702,168

[22] Filed: July 2, 1976

[51] Int. Cl.[2] ..... F01C 1/02; F01C 19/00; F04C 27/00

[52] U.S. Cl. ..... 418/51; 418/53; 418/123

[58] Field of Search ..... 418/49–53, 418/113, 122–124

[56] References Cited

U.S. PATENT DOCUMENTS

| | | | |
|---|---|---|---|
| 3,159,336 | 12/1964 | Paschke | 418/122 |
| 3,182,641 | 5/1965 | Lamm | 418/124 |
| 3,958,907 | 5/1976 | Goloff | 418/113 |

FOREIGN PATENT DOCUMENTS

| | | | |
|---|---|---|---|
| 1,224,089 | 9/1966 | Germany | 418/124 |
| 2,421,134 | 11/1975 | Germany | 418/113 |

OTHER PUBLICATIONS

Clarke et al., *A New Class of Rotary Piston Machine Suitable for Compressors, Pumps, and Internal Combustion Engines,* Proceedings at Institute of Mechanical Engineers, 1972, vol. 186, 62/72, pp. 743–753, 418–453.

*Primary Examiner*—John J. Vrablik

*Attorney, Agent, or Firm*—Wegner, Stellman, McCord, Wiles & Wood

[57] ABSTRACT

An improved apex seal construction for slant axis rotary mechanisms. The mechanism includes a housing defining a chamber having radially inner and outer spherical walls interconnected by opposed, generally radially extending side walls, a shaft journalled in the housing and having an angularly offset portion within the chamber, a rotor within the chamber and journalled on the angularly offset portion. The rotor has a spherical hub and a peripheral, radially outwardly extending flange having plural apexes on each side thereof, each apex being provided with an apex seal receiving groove extending radially the length of the flange and into the hub. An apex seal is loosely received in each groove and extends therefrom to sealingly engage a corresponding one of the side walls. The improved apex seals according to the invention and their corresponding grooves are dimensioned to have a lesser clearance interiorly of the groove than at the point of emergence of the grooves from the flange so as to narrow the gas leakage path about the seals through the grooves.

6 Claims, 6 Drawing Figures

APEX SEALS FOR SLANT AXIS ROTARY MECHANISMS

BACKGROUND OF THE INVENTION

This invention relates to slant axis rotary mechanisms and, more specifically, to improved apex seal constructions in such mechanisms whereby the leakage path about the apex seals is minimized.

In a typical slant axis rotary mechanism construction, apex seals are received in radially extending grooves at the apexes located on each side of a peripheral flange that extend generally radially outwardly from a spherical hub. Such grooves also partially enter the hub. When a pressure differential exists across such an apex seal, the same may tip or cant, or both, within its groove. That portion of the seal within the groove in the hub will engage the side of the groove within the hub and prevent, as long as the seal remains tipped or cocked, the remainder of the side of the seal within that portion of the groove within the flange from contacting the side of the groove within the flange along the entire length thereof. As a consequence, a leakage path around the seal will exist. Such leakage, undesirably, detracts from operating efficiency of the mechanism.

SUMMARY OF THE INVENTION

The principal object of the invention is to provide a new and improved slant axis rotary mechanism. More specifically, it is an object of the invention to provide such a mechanism including improved apex seals whereby the gas leakage path around the seals through seal receiving grooves is minimized or eliminated.

An exemplary embodiment of the invention achieves the foregoing object in a slant axis rotary mechanism including a housing defining an operating chamber having radially inner and outer spherical walls interconnected by opposed, generally radially extending side walls. A shaft is journalled in the housing and has an angularly offset portion within the chamber. A rotor is disposed within the chamber and is journalled on the angularly offset portion. The rotor has a spherical hub and a peripheral, radially outwardly extending flange having plural apexes on each side thereof. At each apex there is disposed an apex seal receiving groove which extends radially the length of the flange and into the hub. Apex seals are loosely received in corresponding ones of the grooves and extend therefrom to sealingly engage a corresponding one of the side walls. According to the invention, the seals in their corresponding grooves are dimensioned to have a lesser clearance interiorly of the groove than at the point of emergence of the grooves from the flange so that the gas leakage path about the seals through the grooves is narrowed.

In a highly preferred embodiment, the seals are tapered toward the surface thereof sealingly engaging the side walls so that when the seals tip whithin their grooves when a pressure differential exists, a side of the seal will contact the side of the groove along the length of the seal to minimize gas leakage.

In a preferred embodiment, grooves are disposed in the sides of the seals at the ends of the seals within the corresponding groove to enhance so-called "gas energization" of the seals.

Preferably, each seal has an end opposite from the surface sealingly engaging the side wall which is free of the taper so as to minimize the tendency of the seal to stick within the groove. In the usual case, the seals are generally L-shaped with the base leg of the seal disposed within that portion of the groove within the hub.

Other objects and advantages will become apparent from the following specification taken in conjunction with the accompanying drawings.

DESCRIPTION OF THE PREFERRED EMBODIMENTS

Figure 1:
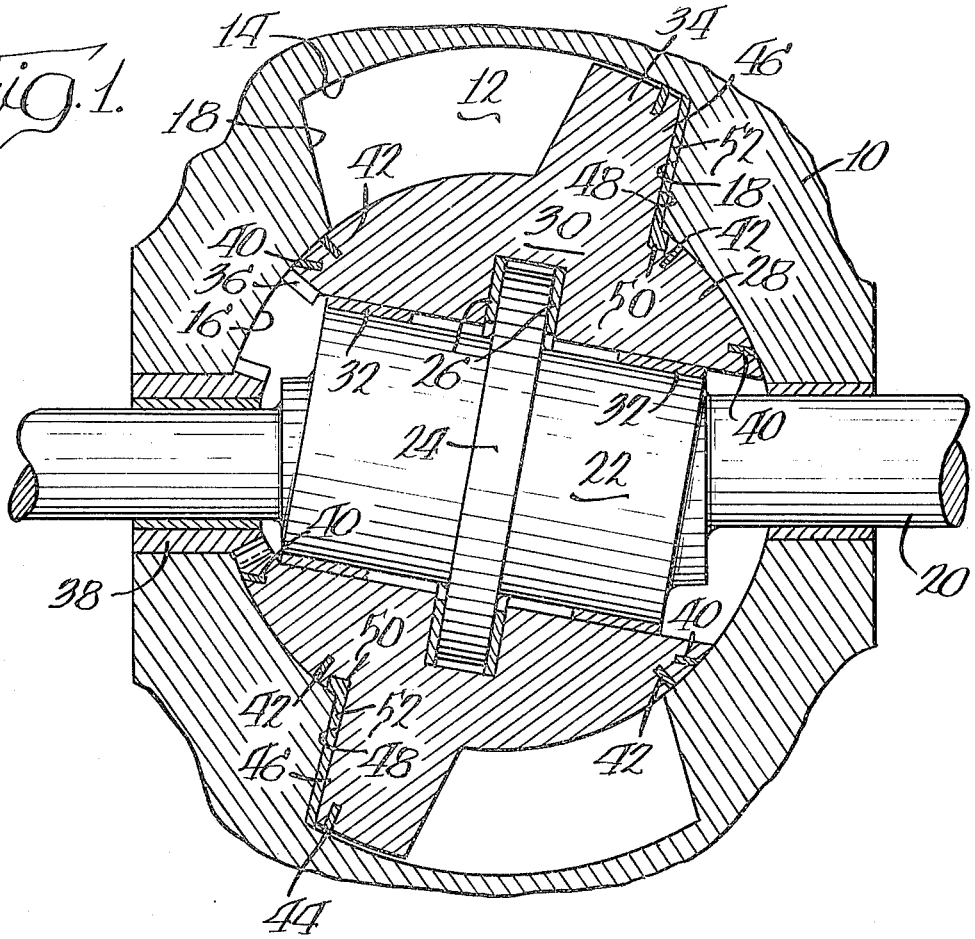
FIG. 1 is a sectional view of a slant axis rotary mechanism embodying the invention.

An exemplary embodiment of a slant axis rotary mechanism made according to the invention is illustrated in FIG. 1 in the form of a four-cycle slant axis rotary mechanism. However, it is to be understood that the principles of the invention will find utility in mechanism operating on other than the four-cycle principle. It is also to be understood that the invention will find utility in such mechanisms, whether employed as engines, compressors, pumps, expanders, or the like.

The slant axis rotary mechanism includes a housing 10 which defines a chamber 12 having a radially outer spherical wall 14, a radially inner spherical wall 16, and opposed, side walls 18 interconnecting the spherical walls 14 and 16. A shaft 20 is journalled in the housing and interiorly of the chamber 12 includes an angularly offset portion 22. The angularly offset portion 22 includes a peripheral thrust collar 24 disposed between bearings 26 carried by the hub 28 of a rotor 30 located within the chamber 12. Journal bearings 32 journal the rotor 30 on the angularly offset portion 22.

The hub 28 of the rotor 30 is spherical as illustrated and the rotor 30 is completed by a radially outwardly extending, peripheral flange 34. At one end of the hub 28 there is a ring gear which is meshed with a timing gear 38 carried by the housing to establish the relative rates of rotation of the shaft and the rotor.

At each end of the hub 28, there are oil seals 40 which sealingly engage the radially inner spherical wall 16. Compression seals 42 are also carried by each end of the hub 28 and also sealingly engage the radially inner spherical wall 16.

The radially outermost periphery of the flange 34 is provided with peripheral seals 44 which sealingly engage the radially outer spherical wall 14. Each side of the flange 34 is provided with a plurality of apexes 46 (only two of which are shown) and, at each apex 46, there is disposed a radially extending, seal receiving groove 48, a portion 50 of which is located within the hub 28. Apex seals 52 are disposed in each of the grooves 48 and sealingly engage a corresponding one of the side walls 18, as illustrated in FIG. 1.

Figure 2:
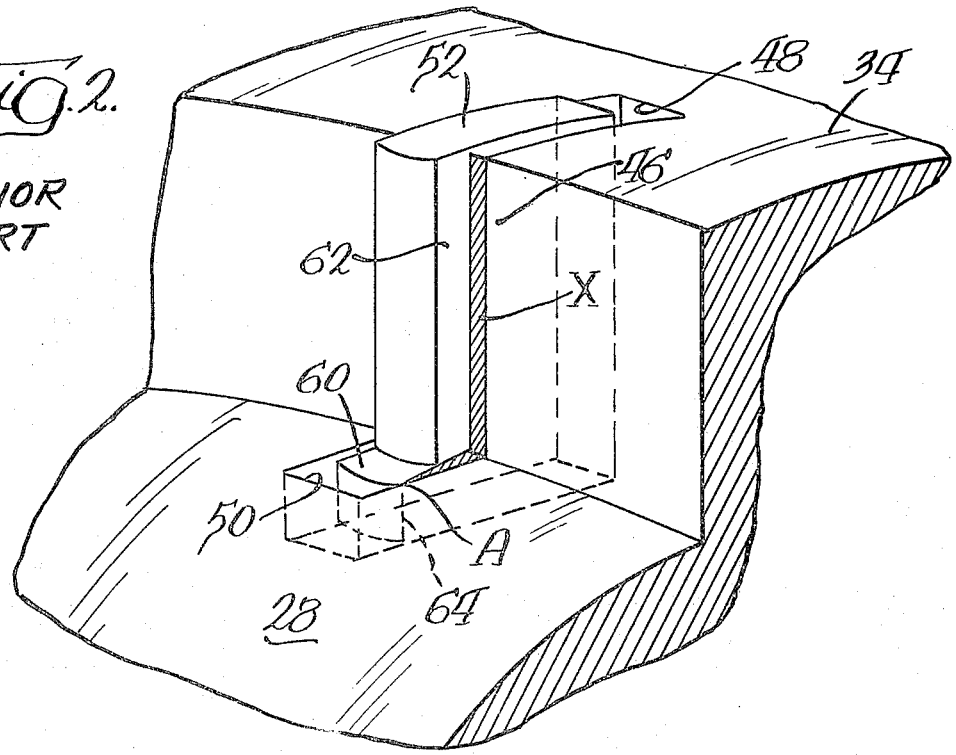
Fig. 2. PRIOR ART
FIG. 2 is a fragmentary perspective view of an apex seal construction made according to the prior art with parts omitted for clarity and showing one configuration of the seal with respect to its groove wherein a sizable leakage path occurs.
Figure 3:
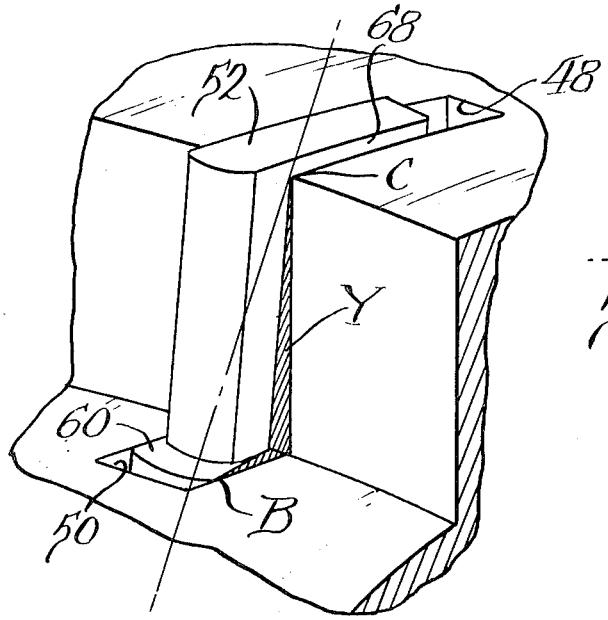
Fig. 3. PRIOR ART
FIG. 3 is a view similar to FIG. 2 showing another configuration of a prior art seal within its groove providing a sizable leakage path.

The problem which the present invention overcomes, and as alluded to previously, is best understood by reference to FIGS. 2 and 3 which illustrate prior art structures with parts omitted for clarity. For example, portions of the peripheral seals 44 and the compression seals 42 would ordinarily be seen in both FIGS. 2 and 3, but have been omitted. At the same time, so-called "bolt" or piston seals, usually located at both ends of an apex seal, that is, in the radially outer periphery of the flange as well as in the hub 28, have been omitted. It is to be understood, however, that a slant axis rotary mechanism made according to the invention contemplates the use of such seals.

In the usual case, each seal 52 will be L-shaped and have a base leg 60 and an upright leg 62. The upright leg 62 will be disposed within the groove 48, while the base leg 60 will be disposed within the portion 50 of the groove 48 within the hub 28. The groove 48 and the portion 50 thereof have a dimension greater than that of the seal 52 so that the same may move into and out of the groove to maintain continual engagement with the corresponding side wall 18. A biasing spring (not shown in FIGS. 2 and 3) is disposed within the groove 48 to urge the seal 52 outwardly into engagement with the corresponding side wall 18.

Because each seal 52 is accordingly loosely received in its corresponding groove 48 and portion 50 thereof, it may tip or cock therein. For example, if it be considered, with reference to FIG. 2, that a greater pressure exists on the left-hand side of the seal 52 than on the right-hand side, such a pressure may cause that portion of the seal 52 extending out of the groove 48 to move toward the right. Such movement will occur until the corner 64 of the base leg 60 engages a side of the groove portion 50 at point A. As a consequence, further cocking of the seal 52 about its longitudinal axis is impeded by reason of the interference at point A. Therefore, on the low pressure side of the seal 52, a leakage path, shown by the shaded area X exists whereby gas under pressure introduced into the groove 46 from the high pressure side of the seal may emerge to the low pressure side.

FIG. 3 illustrates a similar condition. In the case illustrated in FIG. 3, the seal 52 has not only pivoted within its groove about its longitudinal axis, but has tilted as well. The corner 64 of the base leg 60 has engaged the side of the groove portion 50 at a point designated B, while the low pressure side 68 of the seal 52 has made point contact at a point C with the groove 48. As a consequence, a leakage path designated Y, and shown in shading in FIG. 3, exists.

According to the invention, the leakage paths shown as X and Y in FIGS. 2 and 3 are eliminated or minimized by dimensioning the seals in their corresponding grooves to have a lesser clearance interiorly of the groove than at the point of emergence of the grooves from the sides of the flange 34.

In a preferred embodiment, this is accomplished by tapering the seals.

Figure 4:
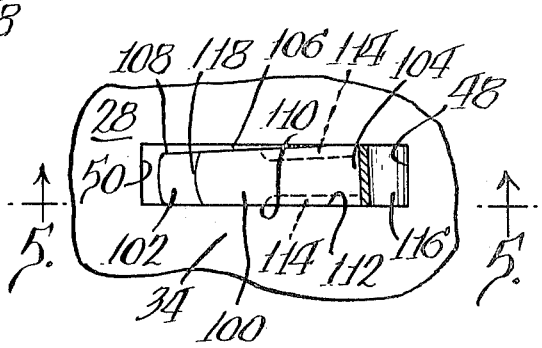
FIG. 4 is an enlarged, fragmentary plan view of an apex seal made according to the invention.
Figure 5:
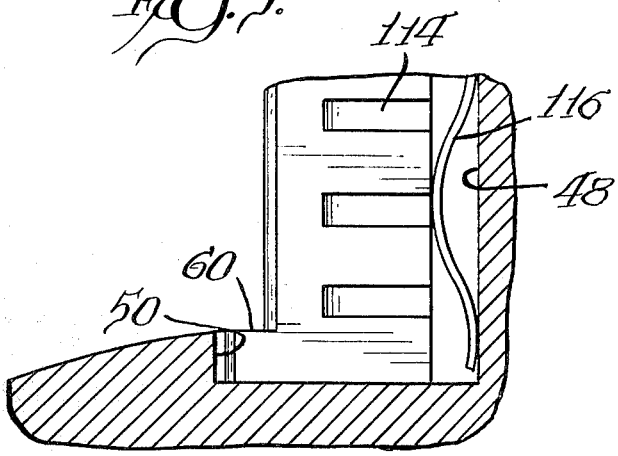
FIG. 5 is a sectional view taken approximately along the line 5—5 in FIG. 4.

Referring to FIGS. 4 and 5, an L-shaped seal 100 made according to the invention is disposed in each groove 48 and includes a base leg 102 disposed within the groove portion 50 in the hub 28. The inwardmost end 104 of the seal 100 is constructed to clear the interior of the groove 48 by an amount on the order of 0.0002 – 0.0004 inches, while that part 106 of the seal 100 adjacent the point of emergence of the groove 48 from the flange 34 has a greater clearance and that portion 108 of the base leg 102 of the seal 100 within the groove portion 50 has an even greater clearance. As a consequence, when a pressure differential exists across the seal 100, the low pressure side 110 thereof will engage the corresponding side 112 of the groove 48 and groove portion 50 over a substantial area to provide excellent sealing contact against the side of the groove and preclude gas leakage.

Preferably, both sides of the seal 100 are provided with grooves 114 whereby gas under pressure from the high pressure side of the seal may enter the groove 48 and act against the bottom of the seal 104 in concert with a biasing spring 116 to urge the sealing surface 118 of the seal into good sealing engagement with the corresponding side wall 18.

Figure 6:
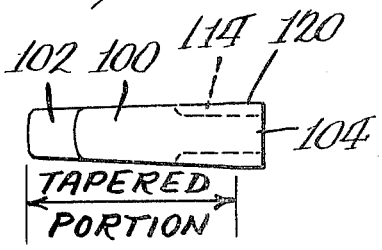
FIG. 6 is a plan view of a modified embodiment of a seal made according to the invention.

FIG. 6 illustrates a highly preferred embodiment of a seal made according to the invention which is configured identically to that shown in FIGS. 4 and 5 except that the end 104 of the seal 100 is provided with a portion 120 that is free of the taper placed on the remainder of the seal. The taper-free portion may have parallel sides or a taper opposite that designated by the legend "TAPERED PORTION" in FIG. 6. If desired, rounded corners at the end 104 could be provided. In any case, the purpose of such a construction is to minimize any tendency of the seal 100 to stick within the groove 48.

From the foregoing, it will be appreciated that an apex seal assembly made according to the invention minimizes or eliminates the leakage path through apex seal receiving grooves in slant axis rotary mechanisms. As a consequence, operational efficiency of the mechanism is enhanced.

I claim:

1. In a slant axis rotary mechanism including a housing defining a chamber having radially inner and outer spherical walls interconnected by opposed, generally radially extending side walls, a shaft journalled in said housing and having an angularly offset portion within said chamber, a rotor within said chamber journalled on the angularly offset portion and having a spherical hub and a peripheral, radially outwardly extending flange having plural apexes on each side thereof, an apex seal receiving groove at each apex extending radially the length of the flange and into the hub, and an apex seal loosely received in and extending along the length of each groove and further extending therefrom to sealingly engage a corresponding one of said side walls, the improvement wherein each said seal is tapered only toward its surface sealingly engaging the corresponding side wall whereby when the seals tip within their grooves when a pressure differential exists, a side thereof may contact a side of the groove along the length of the seal to minimize gas leakage.

2. The slant axis rotary mechanism of claim 1 wherein each said seal has a portion free of said taper at its end within the associated groove.

3. In a slant axis rotary mechanism including a housing defining a chamber having radially inner and outer spherical walls interconnected by opposed, generally radially extending side walls, a shaft journalled in said housing and having an angularly offset portion within said chamber, a rotor within said chamber journalled on the angularly offset portion and having a spherical hub and a peripheral, radially outwardly extending flange having plural apexes on each side thereof, an apex seal receiving groove at each apex extending radially the length of the flange and into the hub, and an L-shaped apex seal loosely received in each groove with its base leg in the hub and having a surface sealingly engaging the associated side wall, the improvement wherein each said seal has sides tapered toward said surface to facilitate sealing engagement of said sides with the sides of the associated groove.

4. The slant axis rotary mechanism of claim 3 further including grooves in said seal sides remote from said seal surfaces.

5. The slant axis rotary mechanism of claim 3 wherein each said seal terminates in a portion remote from said seal surface and free of said taper.

6. The slant axis rotary mechanism of claim 5 wherein said seal portions are provided with grooves.

* * * * *